US009862532B2

(12) United States Patent
McRae

(10) Patent No.: US 9,862,532 B2
(45) Date of Patent: Jan. 9, 2018

(54) WATER BOX APPARATUS AND METHOD

(71) Applicant: LBI BRANDS, INC., Vancouver (CA)

(72) Inventor: Ralph Douglas McRae, Vancouver (CA)

(73) Assignee: LBI Brands, Inc., Vancouver, BC (CA)

( * ) Notice: Subject to any disclaimer, the term of this patent is extended or adjusted under 35 U.S.C. 154(b) by 19 days.

(21) Appl. No.: 14/726,740

(22) Filed: Jun. 1, 2015

(65) Prior Publication Data

US 2016/0347526 A1 Dec. 1, 2016

(30) Foreign Application Priority Data

May 29, 2015 (CA) ..... 2893392

(51) Int. Cl.
*B65D 35/56* (2006.01)
*B65D 77/06* (2006.01)
(Continued)

(52) U.S. Cl.
CPC ..... *B65D 77/065* (2013.01); *B65B 7/02* (2013.01); *B65D 5/563* (2013.01); *B65D 5/566* (2013.01);
(Continued)

(58) Field of Classification Search
CPC .... B65D 77/065; B65D 77/30; B65D 77/067; B65D 5/563; B65D 5/566; B65D 85/72; B65B 7/02
(Continued)

(56) References Cited

U.S. PATENT DOCUMENTS 2,926,829 A * 3/1960 Wilkins ..... B65D 5/563 229/5.84
3,118,588 A * 1/1964 Webley ..... B65D 5/60 229/117.27
(Continued)

FOREIGN PATENT DOCUMENTS

WO WO 2008/090362 A1 7/2008

OTHER PUBLICATIONS

Notice of Allowance dated Nov. 21, 2016, in allowed priority Canadian patent application No. 2,893,392, Canadian Intellectual Property Office (CIPO) (1 page).
(Continued)

*Primary Examiner* — Benjamin R Shaw
(74) *Attorney, Agent, or Firm* — Haynes and Boone, LLP

(57) ABSTRACT

An apparatus includes a box including one or more side walls, each of which defines an inside surface. A bag is disposed in an internal region defined by the box. Drinking water is contained in the bag, the water being non-alcoholic. The bag is adapted to protect the water from contaminants, tastes, and odors, each of which originates from either the bag itself or a source external to the bag. A water-resistant coating may be applied to the respective inside surfaces. When condensate forms on the bag, the water-resistant coating at least resists absorption of the condensate into the one or more side walls. The apparatus may include a spout, which permits the water to be dispensed from the bag for human consumption. In an exemplary embodiment, the water is treated with a sanitizing additive such as, for example, ozone. The apparatus mitigates the environmental impacts of drinking water packaging.

4 Claims, 9 Drawing Sheets

(51) Int. Cl.
*B65B 7/02* (2006.01)
*B65D 5/56* (2006.01)
*B65D 77/30* (2006.01)
*B65D 85/72* (2006.01)

(52) U.S. Cl.
CPC ..... *B65D 77/067* (2013.01); *B65D 77/30* (2013.01); *B65D 85/72* (2013.01)

(58) Field of Classification Search
USPC ..... 222/105; 229/117.29, 117.28, 117.3
See application file for complete search history.

(56) References Cited

U.S. PATENT DOCUMENTS 3,379,537 A * 4/1968 Brandt ..... B65D 5/563 426/124
4,355,737 A * 10/1982 Pongrass ..... B65D 47/263 222/105
4,475,670 A * 10/1984 Rutter ..... B65D 77/067 222/105
5,195,661 A * 3/1993 Light ..... B65D 77/065 222/105
5,627,150 A * 5/1997 Peterson ..... A47L 15/4436 206/515
5,731,021 A * 3/1998 Spector ..... B65D 77/068 222/105
5,788,121 A * 8/1998 Sasaki ..... B65D 77/065 222/105
6,740,346 B2 5/2004 Shapiro
6,794,016 B2 9/2004 Kumabe et al.
7,007,825 B2 * 3/2006 Crosland ..... B65D 5/10 222/105
7,172,108 B2 * 2/2007 Ingalls ..... B65D 5/4266 229/109
8,261,964 B2 * 9/2012 Raupach ..... B65D 5/566 221/302
8,276,806 B2 * 10/2012 Burke ..... B65D 77/062 222/92
8,459,503 B2 * 6/2013 Groesbeck ..... B65D 5/4204 220/592.01
2003/0121798 A1 * 7/2003 Iseki ..... A01G 31/00 205/744
2003/0183650 A1 * 10/2003 Muise ..... B65D 77/065 222/105
2003/0222100 A1 * 12/2003 Husband ..... B65D 1/32 222/105
2005/0211726 A1 * 9/2005 Pritchard ..... B65D 77/067 222/105
2005/0279685 A1 * 12/2005 Hsu ..... B01F 3/04808 210/192
2007/0039974 A1 * 2/2007 Lloyd ..... A23G 9/045 222/105
2007/0196600 A1 * 8/2007 Hutchinson ..... B32B 5/20 428/34.1
2008/0081135 A1 * 4/2008 Spurrell ..... B65D 5/4204 428/34.2
2008/0191001 A1 * 8/2008 Chandaria ..... B32B 3/28 229/100
2008/0277417 A1 * 11/2008 Groesbeck ..... B65D 5/4204 222/105
2009/0078721 A1 * 3/2009 Hoffman ..... B65D 77/06 222/1
2009/0084834 A1 * 4/2009 Duyst ..... B65D 77/065 229/117.3
2009/0101699 A1 * 4/2009 Goudreau ..... B65D 77/065 229/117.27
2009/0283541 A1 * 11/2009 Compton ..... B65D 77/068 222/105
2010/0147884 A1 * 6/2010 Compton ..... B67D 7/0205 222/105
2011/0031303 A1 * 2/2011 Zink ..... B65D 77/067 229/117.35
2011/0036864 A1 * 2/2011 McKenna ..... B65D 77/065 222/105
2011/0215136 A1 * 9/2011 Ouillette ..... B65D 5/5033 229/117.3
2012/0024896 A1 * 2/2012 Scobey ..... B65D 77/06 222/105
2012/0318821 A1 * 12/2012 Merner ..... B65D 77/065 222/105
2013/0284797 A1 * 10/2013 Ouillette ..... B65D 5/46016 229/117.16
2014/0076927 A1 * 3/2014 Brooks ..... B65D 77/067 222/105
2014/0083340 A1 * 3/2014 Dull ..... A01C 23/008 111/120
2014/0261854 A1 * 9/2014 Nemec ..... B67D 7/005 141/1
2014/0263449 A1 9/2014 Forte
2015/0001251 A1 * 1/2015 Smith ..... B65D 5/0227 222/105
2015/0108165 A1 * 4/2015 Merner ..... B65D 77/067 222/105

OTHER PUBLICATIONS

Cover pages of Canadian U.S. Pat. No. 2,893,392, dated Jan. 24, 2017 (2 pages).
Allowed claims 1-22 in Canadian U.S. Pat. No. 2,893,392, submitted to CIPO dated Oct. 14, 2016 (7 pages).
Examination Report dated Mar. 7, 2016 in Canadian Patent Application No. 2,893,392, 4 pages.

* cited by examiner

WATER BOX APPARATUS AND METHOD

CROSS-REFERENCE TO RELATED APPLICATION

This application claims the benefit of the filing date of, and priority to, Canadian patent application number 2,893,392, filed May 29, 2015, now Canadian patent number 2,893,392, issued Jan. 24, 2017, entitled "Water Box Apparatus and Method", the entire disclosure of which is hereby incorporated herein by reference.

BACKGROUND

The present disclosure relates in general to drinking water and, in particular, to packaging drinking water.

Packaging drinking water presents many challenges. Some drinking water packaging solutions such as, for example, polyethylene terephthalate (PET) and BPA-laden water bottles, require relatively large amounts of plastic, increasing their environmental footprints.

DETAILED DESCRIPTION

Figure 1:
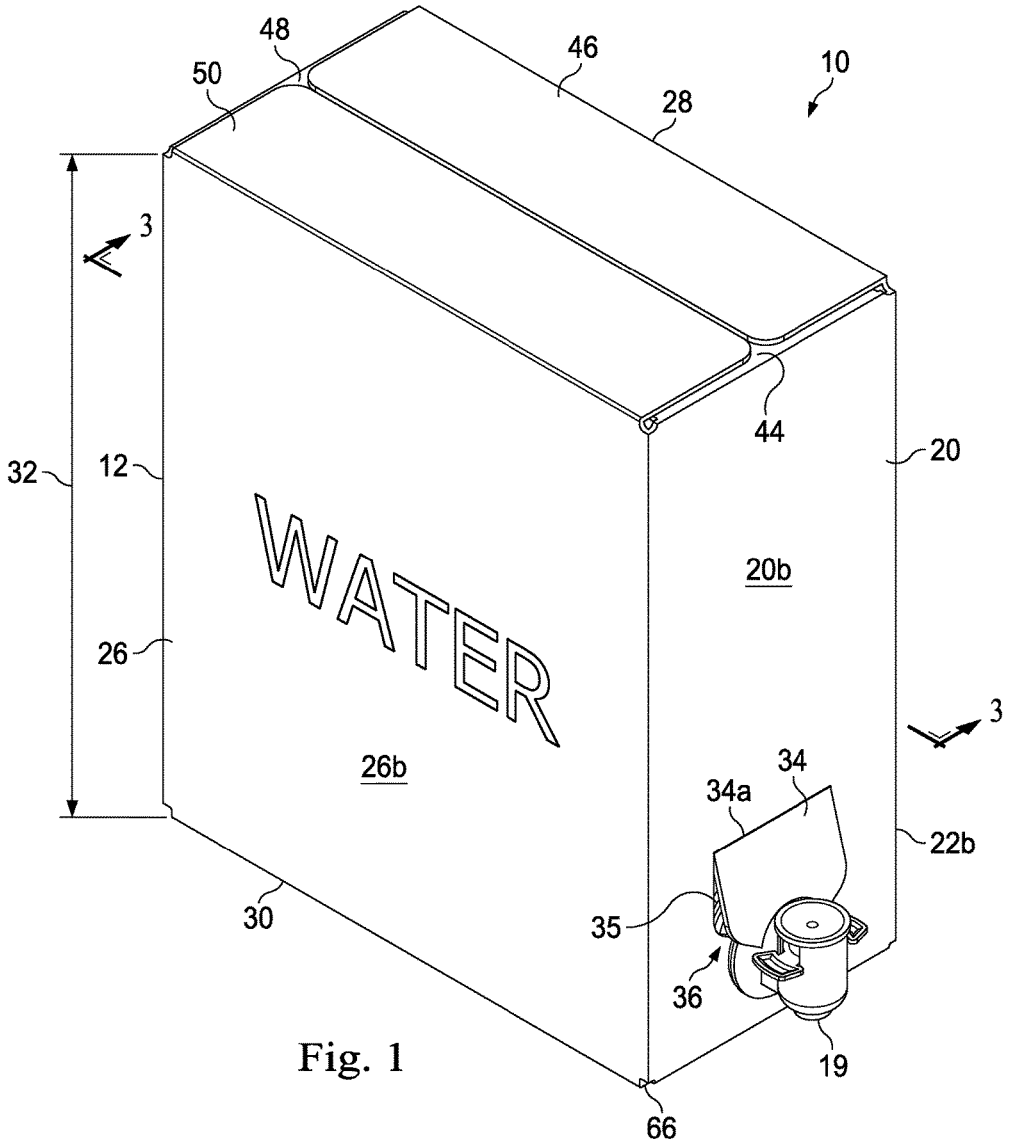
FIG. 1 is a perspective view of a water box apparatus according to an exemplary embodiment, the water box apparatus including a box illustrated in an assembled configuration.
Figure 2:
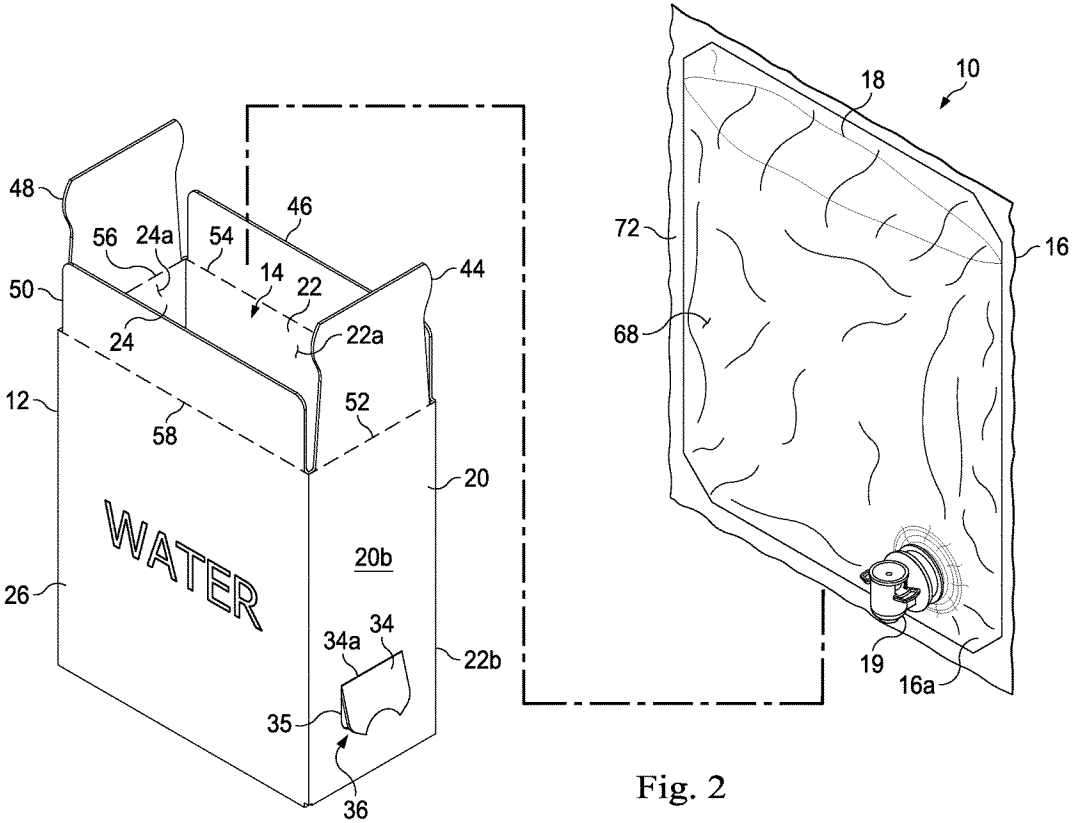
FIG. 2 is an exploded view of the water box apparatus of FIG. 1, according to an exemplary embodiment.
Figure 3:
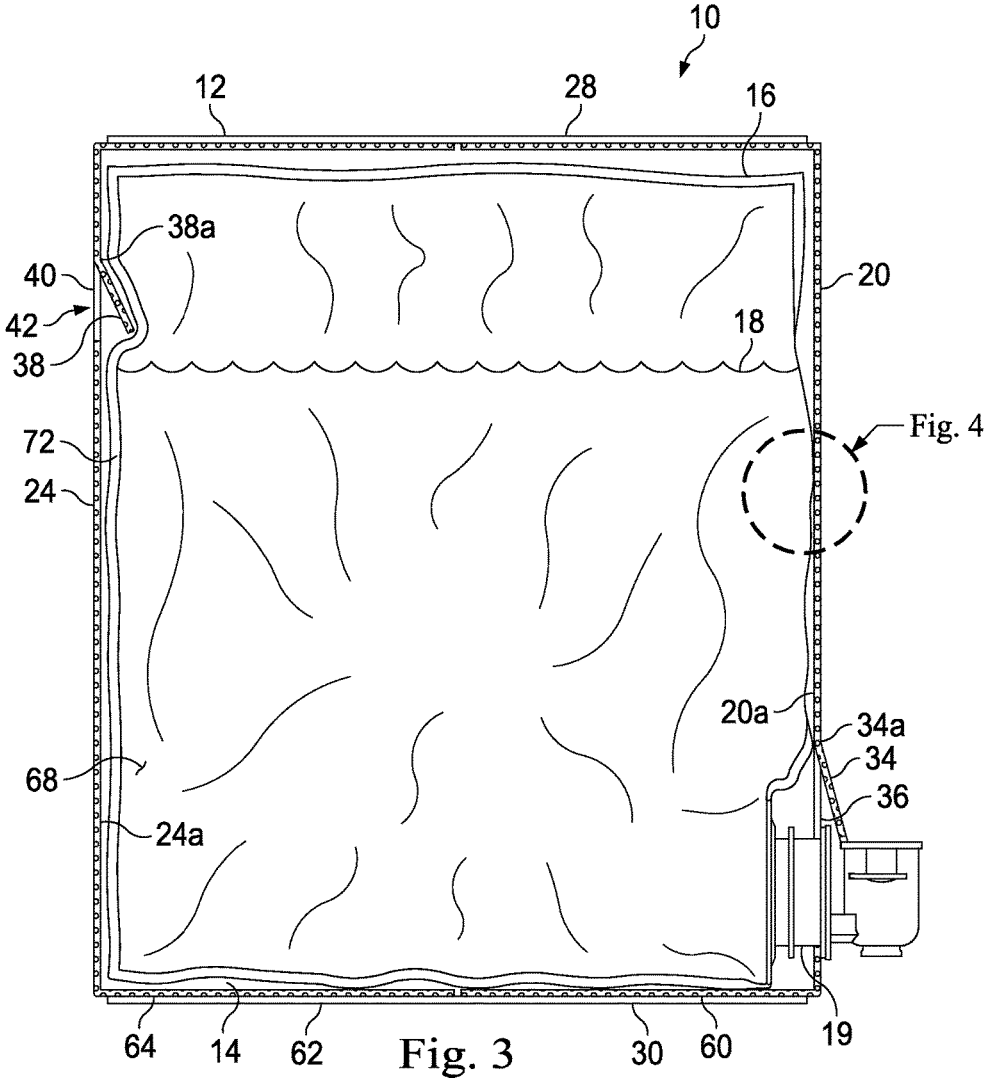
FIG. 3 is a section view of the water box apparatus of FIG. 1 taken along line 3-3 of FIG. 1, according to an exemplary embodiment.

In an exemplary embodiment, as illustrated in FIGS. 1-3, a water box apparatus is generally referred to by the reference numeral 10 and includes a box 12 defining an internal region 14. A bag 16 is disposed within the internal region 14. The bag 16 is sealed. Treated water 18 is contained in the bag 16. A spout 19 is connected to the bag 16 at a lower corner portion 16*a* thereof. The spout 19 is adapted to permit the treated water 18 to be dispensed from the bag 16 for human consumption. In several exemplary embodiments, the spout 19 is, includes, or is part of, a spigot, a faucet, a valve, or any combination thereof. The treated water 18 is treated with a sanitizing additive. In an exemplary embodiment, the sanitizing additive with which the treated water 18 is treated is ozone, and the treated water 18 is ozonated water. The treated water 18 is drinking water and non-alcoholic.

The box 12 includes a plurality of side walls 20, 22, 24, and 26. The side walls 20, 22, and 24 define inside surfaces 20*a*, 22*a*, and 24*a*, respectively. The side wall 26 also defines an inside surface, which is not shown in the figures. Outside surfaces 20*b*, 22*b*, 24*b*, and 26*b* are also defined by the side walls 20, 22, 24 and 26, respectively. The inside surfaces 20*a*, 22*a*, and 24*a*, and the inside surface of the side wall 26, together at least partially define the internal region 14 in which the bag 16 is disposed. The box 12 further includes an upper end 28 and a lower end 30, which are spaced in a generally parallel relation. The spacing between the upper end 28 and the lower end 30 defines a height 32 of the box 12. The side walls 20, 22, 24, and 26 extend vertically between the upper end 28 and the lower end 30.

A flap 34 is hingedly connected to the lower end portion of the side wall 20; in an exemplary embodiment, the flap 34 is hingedly connected via a non-perforated score line 34*a* formed in the outside surface 20*b* of the side wall 20. The flap 34 is defined by a perforated score line 35 formed in the side wall 20; in several exemplary embodiments, the perforated score line 35 may include one or more perforated score lines that are formed in the side wall 20. An opening 36 is formed in the lower end portion of the side wall 20 when the perforated score line 35 is broken and the flap 34 is pivoted outward and away from the outer surface 20*b* of the side wall 20. The bag 16 is disposed in the internal region 14 so that the spout 19 is positioned in the vicinity of the perforated score line 35. The opening 36 is sized so that the spout 19 is permitted to extend through the opening 36. In several exemplary embodiments, the lower corner portion 16*a* of the bag 16 is bent, or twisted, in a direction towards the inside surface 20*a* so that the spout 19 is permitted to extend through the opening 36. In an exemplary embodiment, when the bag 16 is disposed in the internal region 14, the spout 19 may be pulled so that the spout 19 extends through the opening 36, as shown in FIG. 1.

As shown in FIG. 3, a flap 38 is hingedly connected to the upper end portion of the side wall 24; in an exemplary embodiment, the flap 38 is hingedly connected via a non-perforated score line 38*a* formed in the inside surface 24*a* of the side wall 24. The flap 38 is defined by a perforated score line 40 formed in the side wall 24; in an exemplary embodiment, the perforated score line 40 may include one or more perforated score lines. An opening 42 is formed in the upper end portion of the side wall 24 when the perforated score line 40 is broken and the flap 38 is pivoted inward and into the internal region 14. The opening 42 provides a handle feature, allowing a human hand to extend into the internal region 14 and carry or hold the water box apparatus 10 by the portion of the side wall 24 located at the hinged connection between the flap 38 and the side wall 24.

As shown in FIGS. 1-3, the upper end 28 of the box 12 includes flaps 44, 46, 48, and 50, which extend from the upper ends of the side walls 20, 22, 24, and 26, respectively. The flaps 44, 46, 48, and 50 are hingedly connected to the side walls 20, 22, 24, and 26, respectively, via non-perforated score lines 52, 54, 56, and 58, respectively. The non-perforated score lines 52, 54, and 56 are at least partially formed in the inside surfaces 20*a*, 22*a*, and 24*a*, respectively. The non-perforated score line 58 is at least partially formed in the inside surface defined by the side wall 26. To form the upper end 28 of the box 12, the flaps 44 and 48 fold towards the internal region 14. Each of the flaps 46 and 50 folds towards the internal region 14, and are secured to the flaps 44 and 48, thereby forming the upper end 28. In an exemplary embodiment, the flaps 46 and 50 are secured to the flaps 44 and 48 using an adhesive, which is disposed between the flap 46 and the flaps 44 and 48, and between the flap 50 and the flaps 44 and 48.

As shown in FIGS. 1-3, the lower end 30 of the box 12 includes flaps 60, 62, 64, and 66, which extend from the lower ends of the side walls 20, 22, 24, and 26, respectively. The flaps 60, 62, 64, and 66 are hingedly connected to the side walls 20, 22, 24, and 26, respectively, via respective non-perforated score lines 67*a*, 67*b*, 67*c*, and 67*d* (shown in FIG. 6); the non-perforated score lines 67*a*, 67*b*, and 67*c* are at least partially formed in the inside surfaces 20*a*, 22*a*, and 24*a*, respectively, and the non-perforated score line 67*d* is at least partially formed in the inside surface of the side wall 26. To form the lower end 30 of the box 12, the flaps 60 and 64 fold towards the internal region 14. Each of the flaps 62 and 66 folds towards the internal region 14, and are secured to the flaps 60 and 64, thereby forming the lower end 30. In an exemplary embodiment, the flaps 62 and 66 are secured to the flaps 60 and 64 using an adhesive, which is disposed between the flap 62 and the flaps 60 and 64, and between the flap 66 and the flaps 60 and 64.

As shown in FIG. 3, the lower end 30 of the box 12 at least partially supports the bag 16. The lower end of the bag 16 contacts at least the flaps 60 and 64.

Figure 4:
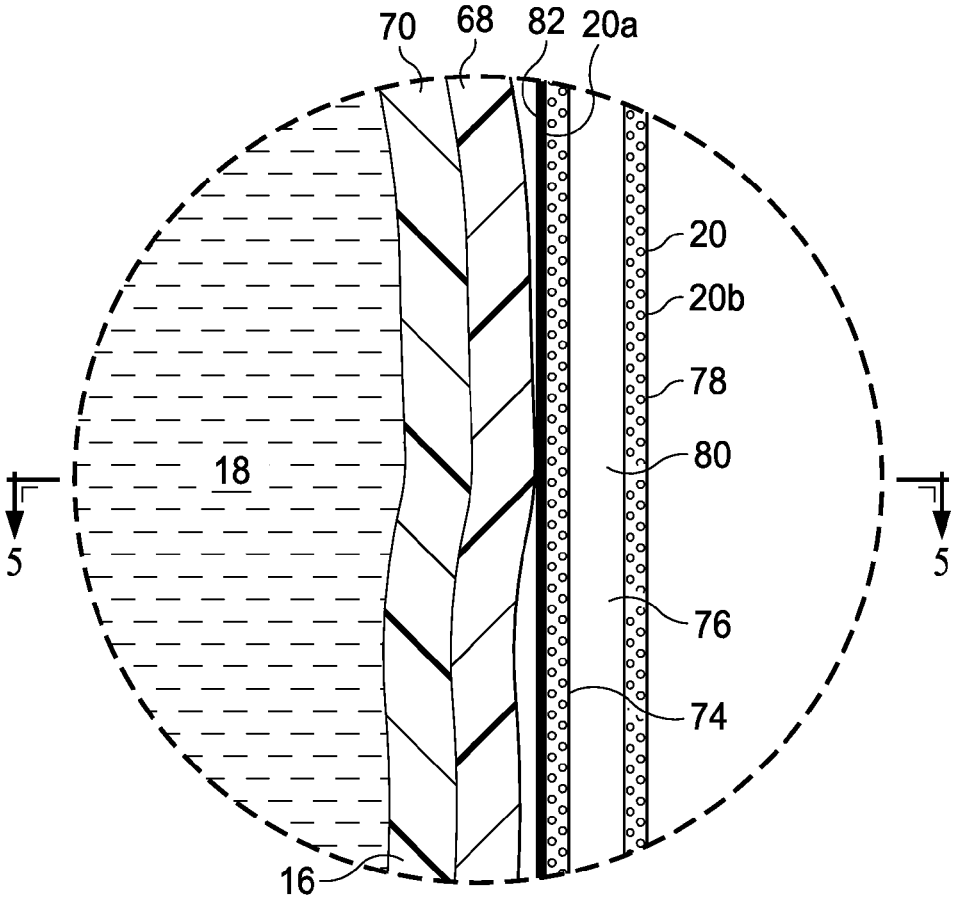
FIG. 4 is an enlarged view of a portion of FIG. 3, according to an exemplary embodiment.
Figure 5:
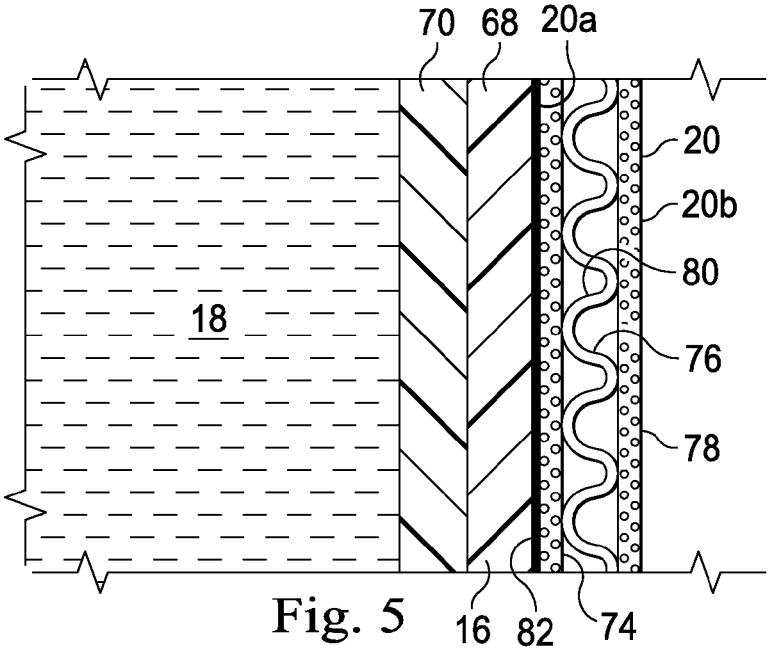
FIG. 5 is a section view of the portion of FIG. 4 taken along line 5-5 of FIG. 4, according to an exemplary embodiment.

In an exemplary embodiment, as illustrated in FIGS. 4 and 5 with continuing reference to FIGS. 1-3, the bag 16 is adapted to protect the treated water 18 contained therein. In an exemplary embodiment, the bag 16 is adapted to protect the treated water 18 contained therein from contaminants, tastes, and odors, each of which originates from either the bag 16 itself or from a source external to the bag 16 (e.g., air in the indoor or outdoor environment surrounding the water box apparatus 10, food positioned near the water box apparatus 10, etc.); the bag 16 so protects the treated water 18 by at least resisting the transmission of such contaminants, tastes, and odors into the treated water 18. In an exemplary embodiment, the bag 16 includes an outer layer 68 and an inner layer 70 mated against the outer layer 68. The inner layer 70 is disposed between the outer layer 68 and the treated water 18. In an exemplary embodiment, the bag 16 is a two-ply bag. In an exemplary embodiment, the layers 68 and 70 are mated against each other and held together by their static properties until a seam weld 72 (shown in FIGS. 2 and 3) is formed around the outer perimeter of the bag 16. As shown in FIG. 3, the spout 19 is connected to the layers 68 and 70.

The outer layer 68 is adapted to provide a barrier against the transmission of at least contaminants and odors into the treated water 18, the contaminants and odors originating from sources external to the bag 16. In an exemplary embodiment, the outer layer 68 is composed of at least a material that is adapted to provide a barrier against the transmission of at least contaminants and odors originating from sources external to the bag 16, as well as the transmission of oxygen through the outer layer 68. In an exemplary embodiment, the outer layer 68 is composed of at least an ethylene vinyl alcohol copolymer (EVOH) to provide a barrier against the transmission of at least contaminants and odors originating from sources external to the bag 16, as well as the transmission of oxygen through the outer layer 68.

The inner layer 70 is composed of at least a material that is different from the material of which the outer layer 68 is at least partially composed. In an exemplary embodiment, the inner layer 70 is composed of at least a material that is: (i) different from the material of which the outer layer 68 is at least partially composed; and (ii) adapted to provide a barrier against at least the transfer of any chemical taste profile(s) (taste(s)) from the outer layer 70 into the treated water 18, which taste(s) are, or include, any taste(s) originating from the outer layer 70 of the bag 16. In an exemplary embodiment, the inner layer 70 is composed of at least a material that: (i) is different from the material of which the outer layer 68 is at least partially composed; and (ii) includes polyethylene (PE) to provide a barrier against at least the transfer of any chemical taste profile(s) (taste(s)) from the outer layer 70 into the treated water 18, which taste(s) are, or include, any taste(s) originating from the outer layer 70 of the bag 16.

In an exemplary embodiment, the bag 16 is a plastic bag. In an exemplary embodiment, the bag 16 is a two-ply plastic bag. In an exemplary embodiment, the bag 16 is a foil bag. In an exemplary embodiment, the bag 16 is a multi-layer foil bag. In an exemplary embodiment, the bag 16 is an aluminum foil bag. In several exemplary embodiments, the bag 16 includes plastic, aluminum, or any combination thereof. In several exemplary embodiments, the bag 16 is a multi-layer bag including plastic, aluminum, or any combination thereof.

As shown in FIGS. 4 and 5, the side wall 20 is constructed from corrugated (or combined) fiberboard and includes an inner linerboard 74, the inner linerboard 74 defining the inside surface 20*a* of the side wall 20. A medium 76 is connected to the inner linerboard 74. An outer linerboard 78 is connected to the medium 76 so that the medium 76 is positioned between the inner linerboard 74 and the outer linerboard 78. As most clearly shown in FIG. 5, the medium 76 includes a plurality of flutes 80, which extend along the height 32 of the box 12; in several exemplary embodiments, due to the extension of the flutes 80 along the height 32 of the box 12, the corrugation direction of the flutes 80 of the medium 76 may be characterized as having a vertical corrugation direction. In several exemplary embodiments, each of the inner linerboard 74 and the outer linerboard 78 is glued to the medium 76 to effect the respective connections therebetween.

In an exemplary embodiment, the side wall 20 is constructed from single wall or double-faced corrugated (or combined) fiberboard, as shown in FIGS. 4 and 5. In an exemplary embodiment, the side wall 20 includes another medium (not shown), which is positioned between the medium 76 and one of the inner linerboard 74 and the outer linerboard 78; another linerboard (not shown) is positioned between the medium 76 and the other medium. In an exemplary embodiment, the side wall 20 is constructed from double wall corrugated (or combined) fiberboard. In several exemplary embodiments, the side wall 20 includes the medium 76 and one or more other mediums, with the medium 76 and the one or more other mediums being positioned between the inner linerboard 74 and the outer linerboard 78, which linerboards are connected to one another via the medium 76 and the one or more other mediums.

In several exemplary embodiments, each of the side walls 22, 24, and 26 is constructed from corrugated fiberboard that is identical, or at least substantially similar, to the above-described corrugated fiberboard from which the side wall 20 is constructed. In several exemplary embodiments, each of the flaps 44, 46, 48, 50, 60, 62, 64, and 66 is constructed from corrugated fiberboard that is identical, or at least substantially similar, to the above-described corrugated fiberboard from which the side wall 20 is constructed, except that the respective sets of flutes 80 of the flaps 44, 46, 48, 50, 60, 62, 64, and 66 extend in directions that are perpendicular to the height 32 of the box 12 when the box 12 is assembled as shown in FIGS. 1 and 3-5 (instead of extending along the height 32 of the box 12).

In several exemplary embodiments, the box 12 is made of single wall, or double-faced, corrugated (or combined) fiberboard.

As shown in FIGS. 4 and 5, a water-resistant coating 82 is applied to the inside surface 20*a*, which as noted above is defined by the inner linerboard 74 of the side wall 20. In an exemplary embodiment, the water-resistant coating 82 is, or includes, Michem® Coat 50AFN coating, which is commercially available from Michelman, Inc., Cincinnati, Ohio USA; in several exemplary embodiments, the water-resistant coating 82 is, or includes, one or more other types of coatings. In an exemplary embodiment, the water-resistant coating 82 is, or includes, wax. In an exemplary embodiment, the water-resistant coating 82 is applied to the inside surface 20*a* of the inner linerboard 74 of the side wall 20 before the inner linerboard 74 is connected to the medium 76 and thus before the side wall 20 is formed in accordance with the foregoing description thereof. The water-resistant coating 82 is applied to the inside surfaces 22*a* and 24*a* of the side walls 22 and 24, respectively, and to the inside surface of the side wall 26. In several exemplary embodiments, the water-resistant coating 82 is applied to the respective inside surfaces of the flaps 44, 46, 48, 50, 60, 62, 64, and 66.

As shown in FIGS. 1 and 3, the box 12 has an assembled configuration in accordance with the foregoing description of the box 12.

Figure 6:
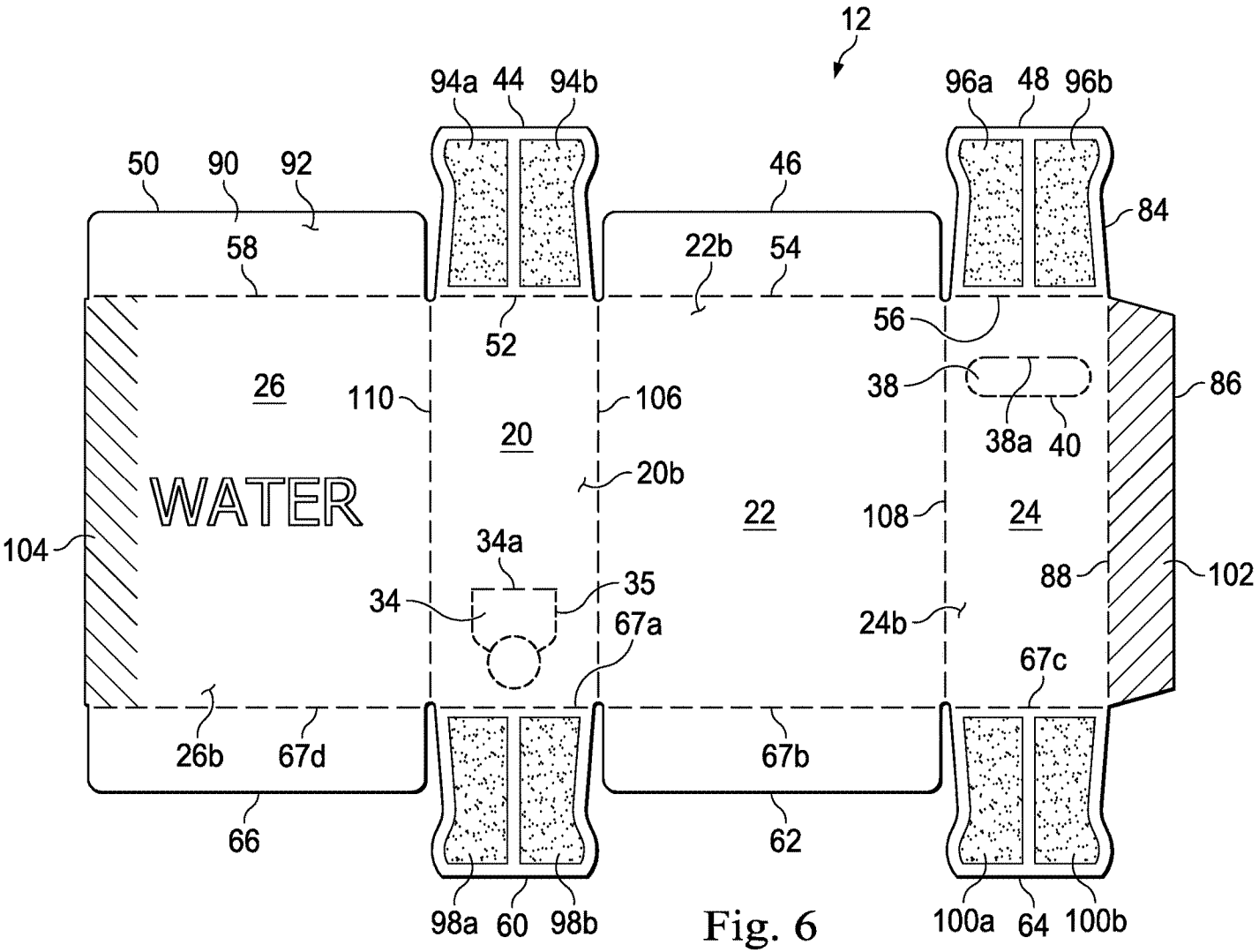
FIG. 6 is a plan view of the box of the water box apparatus of FIG. 1 according to an exemplary embodiment, the box being illustrated in another configuration that is different from the configuration of the box illustrated in FIG. 1.

In an exemplary embodiment, as illustrated in FIG. 6 with continuing reference to FIGS. 1-5, the box 12 has an unassembled configuration in which the box 12 includes a piece 84 of corrugated fiberboard. The side walls 20, 22, 24, and 26, and the flaps 44, 46, 48, 50, 60, 62, 64, and 66, are all portions of the piece 84 of corrugated fiberboard. The piece 84 includes the water-resistant coating 82, the inner linerboard 74, the medium 76, and the outer linerboard 78, as discussed above with respect to the side wall 20. Thus, the side walls 20, 22, 24, and 26, and the flaps 44, 46, 48, 50, 60, 62, 64, and 66, include respective portions of the water-resistant coating 82, the inner linerboard 74, the medium 76, and the outer linerboard 78. The piece 84 is planar and the inner linerboard 74 and the outer linerboard 78 are spaced in a generally parallel relation. The piece 84 includes a flap 86, which extends from, and along, the side wall 24. The flap 86 is hingedly connected to the side wall 24 via a non-perforated score line 88, which is at least partially formed in the inside surface 24*a* of the side wall 24.

In an exemplary embodiment, when the box 12 is in the unassembled configuration shown in FIG. 6, the water-resistant coating 82 is applied across the inner linerboard 74 and thus across the inside surfaces 20*a*, 22*a*, and 24*a*, the inside surface of the side wall 26, and the respective inside surfaces of the flaps 44, 46, 48, 50, 60, 62, 64, and 66.

In an exemplary embodiment, a label 90 is connected to the outer linerboard 78, and the label 90 defines each of the respective outside surfaces 20*b*, 22*b*, 24*b*, and 26*b* of the side walls 20, 22, 24, and 26. In an exemplary embodiment, an external coating 92 is applied to at least a portion of the label 90. In an exemplary embodiment, the external coating 92 is an aqueous coating. In an exemplary embodiment, keep-out portions 94*a* and 94*b* of the label 90 are defined on the outside surface of the flap 44, keep-out portions 96*a* and 96*b* of the label 90 are defined on the outside surface of the flap 48, keep-out portions 98*a* and 98*b* of the label 90 are defined on the outside surface of the flap 60, keep-out portions 100*a* and 100*b* of the label 90 are defined on the outside surface of the flap 64, and a keep-out portion 102 of the label 90 is defined on the outside surface of the flap 86. In an exemplary embodiment, the external coating 92 is not applied to the keep-out portions 94*a*, 94*b*, 96*a*, 96*b*, 98*a*, 98*b*, 100*a*, 100*b*, and 102. A plurality of perforations 104 are formed in at least the inside surface 26*a* of the side wall 26. A non-perforated score line 106 is formed in the inner linerboard 74 and defines the boundary between the side walls 20 and 22. A non-perforated score line 108 is formed in the inner linerboard 74 and defines the boundary between the side walls 22 and 24. A non-perforated score line 110 is formed in the inner linerboard 74 and defines the boundary between the side walls 26 and 20.

In an exemplary embodiment, to change the box 12 from the unassembled configuration shown in FIG. 6 to the assembled configuration shown in FIGS. 1 and 3, an adhesive is applied to the keep-out portions 98*a*, 98*b*, 100*a*, 100*b*, and 102. Before, during, or after this application of adhesive, at least four of the flap 86 and the side walls 20, 22, 24, and 26 are folded along the respective ones of the non-perforated score lines 88, 106, 108, and 110 adjacent thereto to form the four-sided structure shown in FIGS. 1 and 3. The flap 86 engages the inside surface of the side wall 26 so that the adhesive connects the flap 86 to the side wall 26. The absence of the external coating 92 from the keep-out portion 102 facilitates the adhesive connection between the flap 86 and the side wall 26. The perforations 104 also facilitate the adhesive connection between the flap 86 and the side wall 26.

In an exemplary embodiment, to form the lower end 30 of the assembled configuration, the flaps 60 and 64 are folded towards the internal region 14 and about the non-perforated scores lines 67*a* and 67*c*, respectively. The flaps 62 and 66 are folded towards the internal region 14 and about the non-perforated score lines 67*b* and 67*d*, respectively. Each of the flaps 62 and 66 engage the flaps 60 and 64 so that the adhesive connects each of the flaps 62 and 66 to the flaps 60 and 64. The absence of the external coating 92 from the keep-out portions 98*a*, 98*b*, 100*a*, and 100*b* facilitates the adhesive connections of each of the flaps 62 and 66 to the flaps 60 and 64.

In an exemplary embodiment, before, during, or after the formation of the lower end 30, the upper end 28 is formed by folding the flaps 44 and 48 towards the internal region 14 and about the non-perforated score lines 52 and 56, respectively. The flaps 46 and 50 are folded towards the internal region 14 and about the non-perforated score lines 54 and 58, respectively. Each of the flaps 46 and 50 engage the flaps 44 and 48 so that the adhesive connects each of the flaps 46 and 50 to the flaps 44 and 48. The absence of the external coating 92 from the keep-out portions 94*a*, 94*b*, 96*a*, and 96*b* facilitates the adhesive connections of each of the flaps 46 and 50 to the flaps 44 and 48.

In several exemplary embodiments, the bag 16 is disposed in the internal region 14 before either the lower end 30 is formed or the upper end 28 is formed. In an exemplary embodiment, the lower end 30 is formed in accordance with the foregoing, then the bag 16 is disposed in the internal region 14 in accordance with the foregoing, and then the upper end 28 is formed in accordance with the foregoing.

In operation, in an exemplary embodiment, with continuing reference to FIGS. 1-6, the water box apparatus 10 permits the treated water 18 to be easily transported, stored, and dispensed for human consumption. The opening 42 provides a handle feature, allowing a human hand to extend into the internal region 14 and carry or hold the water box apparatus 10 by the portion of the side wall 24 located at the hinged connection between the flap 38 and the side wall 24. The spout 19 is adapted to permit the treated water 18 to be dispensed from the bag 16 for human consumption.

During operation, in an exemplary embodiment, water condensate forms on the outside surface of the outer layer 68 of the bag 16 within the internal region 14; however, the water-resistant coating 82 at least resists absorption of the condensate into the side walls 20, 22, 24, and 26 of the box 12. In an exemplary embodiment, the water-resistant coating 82 at least resists absorption of the condensate into the side walls 20, 22, 24, and 26 of the box 12 to reduce the risk of the condensate causing structural damage to the box 12. Thus, in several exemplary embodiments, the water box apparatus 10 may be chilled in a refrigerator or other device, and condensate may form on the bag 16 within the internal region 14 as a result of this chilling or refrigeration, with the condensate causing little or no structural damage to the box 12. As a result, the water box apparatus 10 may be repeatedly refrigerated or chilled with little or no structural damage to the box 12 due to any condensate that forms on the bag 16 within the internal region 14. Moreover, the water box apparatus 10 may be used in hot and/or humid environments because any condensate formed on the bag 16 within the internal region 14, due to the heat and/or humidity, is not easily absorbed into the box 12 because of the operation of the water-resistant coating 82. Additionally, when moisture forms or collects on the outside surfaces 20*b*, 22*b*, 24*b*, and 26*b*, the external coating 92 at least resists absorption of the moisture into the side walls 20, 22, 24, and 26, reducing the risk of the moisture causing structural damage to the box 12. The external coating 92 also resists scuffing of the box 12.

During operation, in an exemplary embodiment, the extension of the plurality of flutes 80 along the height 32 of the box 12 (i.e., the vertical corrugation direction of the flutes 80) increases the strength of the box 12 during the operation of the water box apparatus 10. As a result, the box 12 is better able to structurally withstand loads applied against the side walls 20, 22, 24, and 26 as a result of the bag 12 containing the water 18 and being disposed in the internal region 14, as well as loads experienced during the transportation of the water box apparatus 10, the storage of the water box apparatus 10, the repeated dispensing of the treated water 18 from the water box apparatus 10, the repeated chilling or refrigeration of the water box apparatus 10, etc.

During operation, in several exemplary embodiments, the sanitizing additive sanitizes the treated water 18 so that the treated water 18 is safe for human consumption. As noted above, in several exemplary embodiments, the sanitizing additive with which the treated water 18 is treated is ozone, and the treated water 18 is ozonated water. In an exemplary embodiment, the sanitizing additive is omitted from the water 18; for example, the water 18 may instead be aseptically packaged, and/or packaged sanitarily using other procedure(s), at the water source.

During operation, in several exemplary embodiments, the packaging of the treated water 18 protects the treated water 18. More particularly, the sealed bag 16 in which the treated water 18 is contained protects the treated water 18 from contaminants, tastes, and odors, each of which originates from either the bag 16 itself or from a source external to the bag 16 (e.g., air in the indoor or outdoor environment surrounding the water box apparatus 10, food positioned near the water box apparatus 10, etc.); the bag 16 so protects the treated water 18 by at least resisting the transmission of such contaminants, tastes, and odors into the treated water 18.

During operation, in several exemplary embodiments, the outer layer 68 provides a barrier against the transmission of at least contaminants and odors into the treated water 18, the contaminants and odors originating from sources that are external to the bag 16. Such contaminants may include airborne dust particles, moisture, oils, liquids, etc., and such odors may originate from, for example, food or other materials near the water box apparatus 10. In an exemplary embodiment, the outer layer 68 provides a barrier against the transmission of at least contaminants and odors originating from sources external to the bag 16, as well as the transmission of oxygen through the outer layer 68, providing a longer shelf life for the treated water 18.

During operation, in several exemplary embodiments, the inner layer 70 provides a barrier against at least the transfer of any chemical taste profile(s) (taste(s)) from the outer layer 70 into the treated water 18, which taste(s) are, or include, any taste(s) originating from the outer layer 70 of the bag 16.

During operation, in several exemplary embodiments, the box 12 protects the sealed bag 16 from damage, thereby also protecting the treated water 18 contained within the bag 16. As noted above, in several exemplary embodiments, the extension of the plurality of flutes 80 along the height 32 of the box 12 increases the strength of the box 12 during the operation of the water box apparatus 10. As a result, the box 12 is able to protect the sealed bag 16 from loads experienced during the transportation of the water box apparatus 10, the storage of the water box apparatus 10, the repeated dispensing of the treated water 18 from the water box apparatus 10, the repeated chilling or refrigeration of the water box apparatus 10, etc. The water-resistant coating 82 facilitates the protection of the sealed bag 16 by at least resisting absorption of any condensate within the internal region 14 into the box 12 to reduce the risk of the condensate causing structural damage to the box 12. This is especially helpful when the water box apparatus 10 is used in hot or humid environments, and/or is repeatedly chilled or refrigerated.

In several exemplary embodiments, the box 12 and the bag 16 of the water box apparatus 10 are recyclable.

In several exemplary embodiments, the water box apparatus 10 dramatically reduces the environmental footprint of drinking water packaging, mitigating the environmental impact of drinking water packaging. More particularly, in several exemplary embodiments, the water box apparatus 10 contains a volume of the treated water 18, and the amount of plastic in the bag 16 that contains the volume is 85% less than the amount of plastic needed for some 500 ml plastic water bottles and caps to contain that same volume of the treated water 18. In an exemplary embodiment, the water box apparatus 10 contains about 5 liters of the treated water 18, and the amount of plastic in the bag 16 that contains the 5 liters is 85% less than the amount of plastic needed for some 500 ml plastic water bottles and caps to contain the 5 liters of the treated water 18. The water box apparatus 10 uses 85% less plastic than some bottled water solutions. In several exemplary embodiments, the water box apparatus 10 mitigates the environmental impacts of drinking water packaging.

In several exemplary embodiments, the water box apparatus 10 offers an attractive alternative to polyethylene terephthalate (PET) and BPA-laden water bottles, holding the same volume of the treated water 18 but using less plastic and dramatically reducing the environmental footprint of water packaging.

Figure 7:
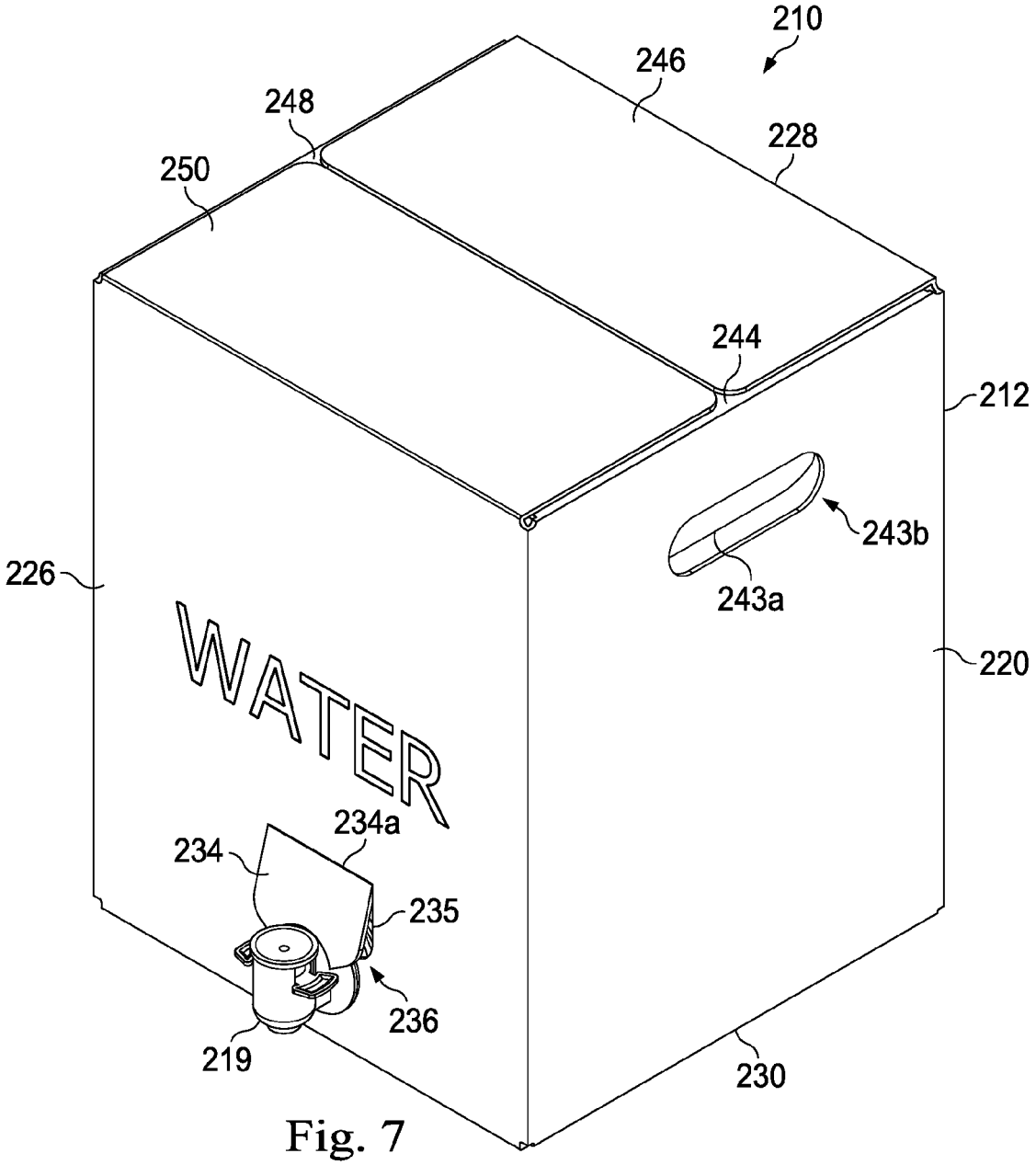
FIG. 7 is a perspective view of a water box apparatus according to an exemplary embodiment, the water box apparatus including a box illustrated in an assembled configuration.
Figure 8:
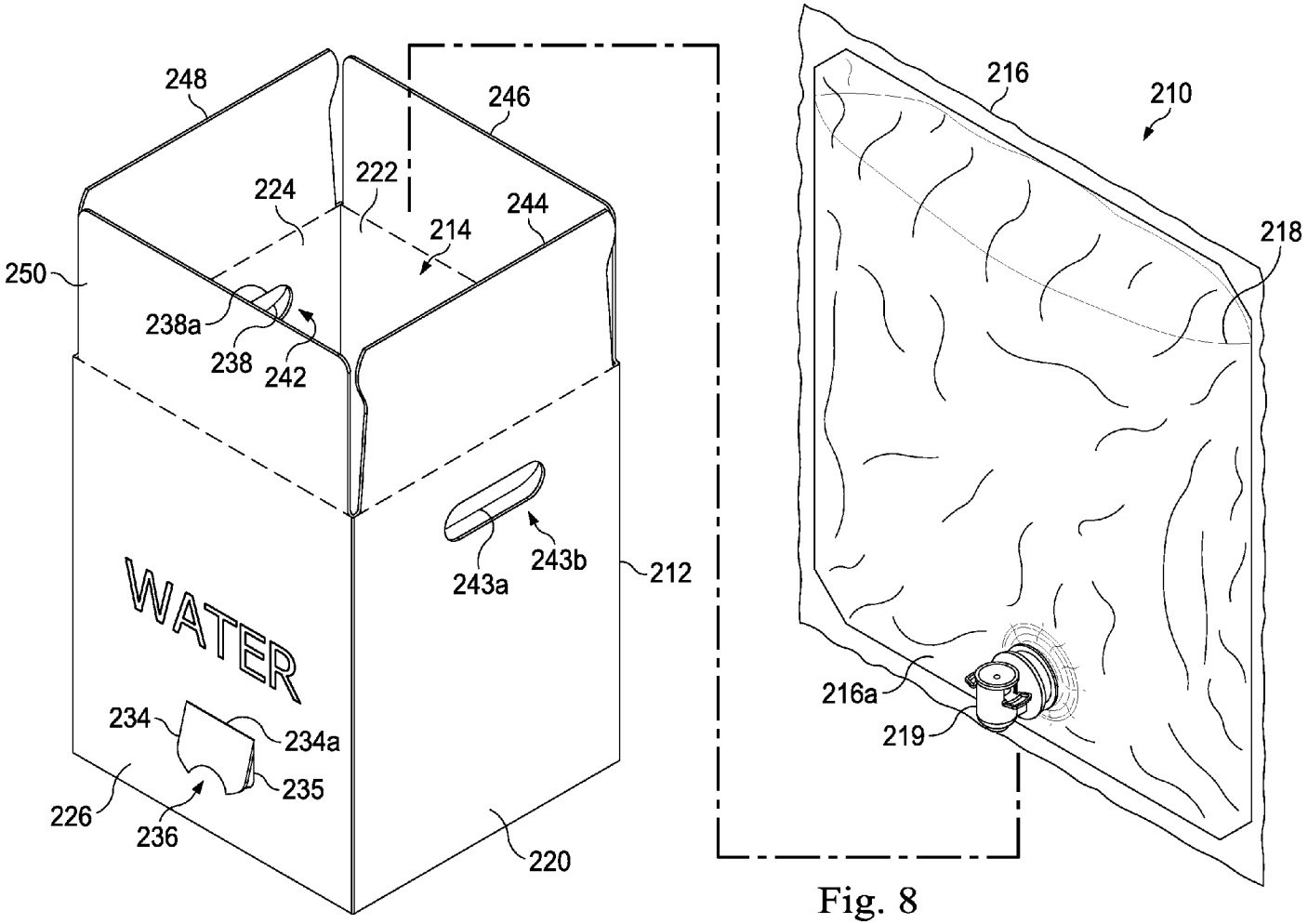
FIG. 8 is an exploded view of the water box apparatus of FIG. 7, according to another exemplary embodiment.
Figure 9:
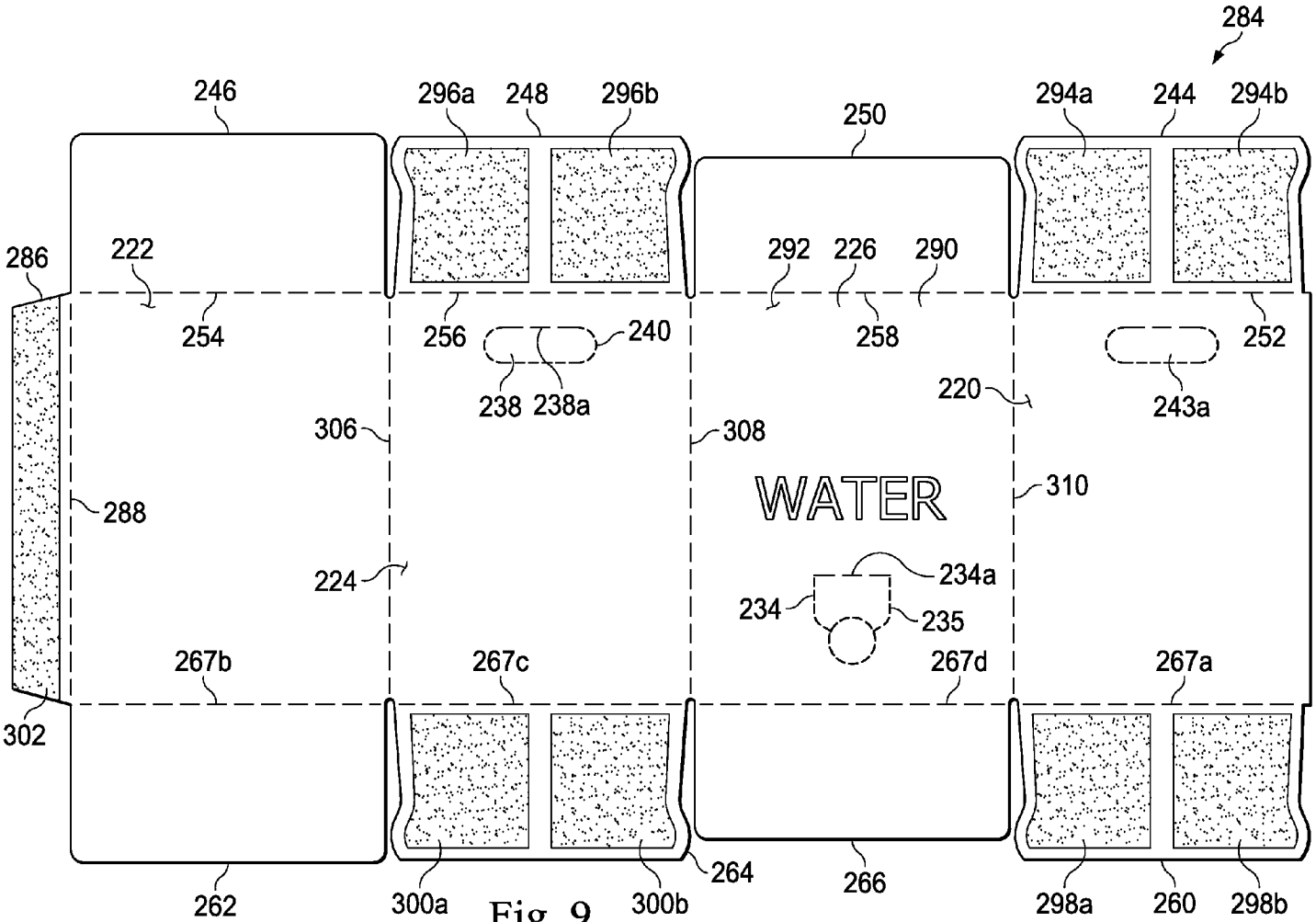
FIG. 9 is a plan view of the box of the water box apparatus of FIG. 7 according to an exemplary embodiment, the box being illustrated in another configuration that is different from the configuration of the box illustrated in FIG. 7.

In an exemplary embodiment, as illustrated in FIGS. 7-9 with continuing reference to FIGS. 1-6, a water box apparatus is generally referred to by the reference numeral 210 and includes a box 212 defining an internal region 214. A bag 216 is disposed within the internal region 214. The bag 216 is sealed. Treated water 218 is contained in the bag 216. A spout 219 is connected to the bag 216 at a lower middle portion 216*a* thereof. The bag 216 is substantially similar to the bag 16 described above, except that the bag 216 is sized to contain a volume of treated water that is greater than the volume of the treated water 18 that is contained by the bag 16, and except that the spout 219 is connected to the lower middle portion 216*a* of the bag 216 rather than to a lower corner portion thereof. Therefore, the bag 216 will not be described in further detail. The treated water 218 is identical to the treated water 18 described above and thus the treated water 218 will not be described in further detail. The spout 219 is identical to the spout 19 described above and therefore will not be described in further detail.

The construction of the box 212 is similar to the construction of the box 12. The box 212 includes a plurality of side walls 220, 222, 224, and 226, the inside surfaces of which together at least partially define the internal region 214 in which the bag 216 is disposed. The box 212 further includes an upper end 228 and a lower end 230, which are spaced in a generally parallel relation. The side walls 220, 222, 224, and 226 extend vertically between the upper end 228 and the lower end 230.

A flap 234 is hingedly connected to the lower end portion of the side wall 226; in an exemplary embodiment, the flap 234 is hingedly connected via a non-perforated score line 234*a* formed in the outside surface of the side wall 226. The flap 234 is defined by a perforated score line 235 formed in the side wall 226; in several exemplary embodiments, the perforated score line 235 may include one or more perforated score lines that are formed in the side wall 226. An opening 236 is formed in the lower end portion of the side wall 226 when the perforated score line 235 is broken and the flap 234 is pivoted outward and away from the outer surface of the side wall 226. The bag 216 is disposed in the internal region 214 so that the spout 219 is positioned in the vicinity of the perforated score line 235. The opening 236 is sized so that the spout 219 is permitted to extend through the opening 236. In an exemplary embodiment, when the bag 216 is disposed in the internal region 214, the spout 219 may be pulled so that the spout 219 extends through the opening 236, as shown in FIG. 7.

A flap 238 is hingedly connected to the upper end portion of the side wall 224; in an exemplary embodiment, the flap 238 is hingedly connected via a non-perforated score line 238*a* formed in the inside surface of the side wall 224. The flap 238 is defined by a perforated score line 240 formed in the side wall 224; in an exemplary embodiment, the perforated score line 240 may include one or more perforated score lines. An opening 242 is formed in the upper end portion of the side wall 224 when the perforated score line 240 is broken and the flap 238 is pivoted inward and into the internal region 214. A flap 243*a* is hingedly connected to the upper end portion of the side wall 220 in a manner identical to the manner in which the flap 238 is hingedly connected to the upper end portion of the side wall 224. An opening 243*b* is formed in the upper end portion of the side wall 220 in a manner identical to the manner in which the opening 242 is formed in the side wall 224. The openings 242 and 243*b* provide handle features, each allowing a human hand to extend into the internal region 14 and carry or hold the water box apparatus 210 by portion(s) of the side wall 224 and/or the side wall 220.

The upper end 228 of the box 212 includes flaps 244, 246, 248, and 250, which extend from the upper ends of the side walls 220, 222, 224, and 226, respectively. The flaps 244, 246, 248, and 250 are hingedly connected to the side walls 220, 222, 224, and 226, respectively, via non-perforated score lines 252, 254, 256, and 258, respectively. The non-perforated score lines 252, 254, 256, and 258 are at least partially formed in the respective inside surfaces of the side walls 220, 222, 224, and 226.

The lower end 230 of the box 12 includes flaps 260, 262, 264, and 266, which extend from the lower ends of the side walls 220, 222, 224, and 226, respectively. The flaps 260, 262, 264, and 266 are hingedly connected to the side walls 220, 222, 224, and 226, respectively, via respective non-perforated score lines 267*a*, 267*b*, 267*c*, and 267*d*; the non-perforated score lines 267*a*, 267*b*, 267*c*, and 267*d* are at least partially formed in the respective inside surfaces of the side walls 220, 222, 224, and 226. The lower end 230 of the box 212 at least partially supports the bag 216.

In several exemplary embodiments, the structure of each of the side walls 220, 222, 224, and 226, and the flaps 244, 246, 248, 250, 260, 262, 264, and 266, is identical the above-described structure of the side wall 20 and thus each includes the water-resistant coating 82, the inner linerboard 74, the medium 76, and the outer linerboard 78. In an exemplary embodiment, each of the side walls 220, 222, 224, and 226 is constructed from double wall corrugated (or combined) fiberboard. In several exemplary embodiments, each of the side walls 220, 222, 224, and 226 includes the medium 76 and one or more other mediums, with the medium 76 and the one or more other mediums being positioned between the inner linerboard 74 and the outer linerboard 78, which linerboards are connected to one another via the medium 76 and the one or more other mediums.

As shown in FIG. 9, the box 212 has an unassembled configuration in which the box 12 includes a piece 284 of corrugated fiberboard. The side walls 220, 222, 224, and 226, and the flaps 244, 246, 248, 250, 260, 262, 264, and 266, are all portions of the piece 284 of corrugated fiberboard. The piece 284 includes the water-resistant coating 82, the inner linerboard 74, the medium 76, and the outer linerboard 78, as discussed above with respect to the side wall 20. Thus, the side walls 220, 222, 224, and 226, and the flaps 244, 246, 248, 250, 260, 262, 264, and 266, include respective portions of the water-resistant coating 82, the inner linerboard 74, the medium 76, and the outer linerboard 78. The piece 284 is planar and the inner linerboard 74 and the outer linerboard 78 are spaced in a generally parallel relation. The piece 284 includes a flap 286, which extends from, and along, the side wall 222. The flap 286 is hingedly connected to the side wall 222 via a non-perforated score line 288, which is at least partially formed in the inside surface of the side wall 222.

In an exemplary embodiment, when the box 212 is in the unassembled configuration shown in FIG. 9, the water-resistant coating 82 is applied across the inner linerboard 74 and thus across the respective inside surfaces of the side walls 220, 222, 224, and 226, and the flaps 244, 246, 248, 250, 260, 262, 264, and 266.

In an exemplary embodiment, a label 290 is connected to the outer linerboard 78, and the label 290 defines each of the respective outside surfaces of the side walls 220, 222, 224, and 226. In an exemplary embodiment, an external coating 292 is applied to at least a portion of the label 290. In an exemplary embodiment, keep-out portions 294*a* and 294*b* of the label 290 are defined on the outside surface of the flap 244, keep-out portions 296*a* and 296*b* of the label 290 are defined on the outside surface of the flap 248, keep-out portions 298*a* and 298*b* of the label 290 are defined on the outside surface of the flap 260, keep-out portions 300*a* and 300*b* of the label 290 are defined on the outside surface of the flap 264, and a keep-out portion 302 of the label 290 is defined on the outside surface of the flap 286. In an exemplary embodiment, the external coating 292 is not applied to the keep-out portions 294*a*, 294*b*, 296*a*, 296*b*, 298*a*, 298*b*, 300*a*, 300*b*, and 302. A non-perforated score line 306 is formed in the inner linerboard 74 and defines the boundary between the side walls 222 and 224. A non-perforated score line 308 is formed in the inner linerboard 74 and defines the boundary between the side walls 224 and 226. A non-perforated score line 310 is formed in the inner linerboard 74 and defines the boundary between the side walls 226 and 220.

In an exemplary embodiment, to change the box 212 from the unassembled configuration shown in FIG. 9 to the assembled configuration shown in FIG. 7, an adhesive is applied to the keep-out portions 298*a*, 298*b*, 300*a*, 300*b*, and 302. Before, during, or after this application of adhesive, at least four of the flap 286 and the side walls 220, 222, 224, and 226 are folded along the respective ones of the non-perforated score lines 288, 306, 308, and 310 adjacent thereto to form the four-sided structure shown in FIG. 7. The flap 286 engages the inside surface of the side wall 220 so that the adhesive connects the flap 286 to the side wall 220. The absence of the external coating 292 from the keep-out portion 302 facilitates the adhesive connection between the flap 286 and the side wall 220.

In an exemplary embodiment, to form the lower end 230 of the assembled configuration, the flaps 260 and 264 are folded towards the internal region 214 and about the non-perforated scores lines 267*a* and 267*c*, respectively. The flaps 262 and 266 are folded towards the internal region 214 and about the non-perforated score lines 267*b* and 267*d*, respectively. Each of the flaps 262 and 266 engage the flaps 260 and 264 so that the adhesive connects each of the flaps 262 and 266 to the flaps 260 and 264. The absence of the external coating 292 from the keep-out portions 298*a*, 298*b*, 300*a*, and 300*b* facilitates the adhesive connections of each of the flaps 262 and 266 to the flaps 260 and 264.

In an exemplary embodiment, before, during, or after the formation of the lower end 230, the upper end 228 is formed by folding the flaps 244 and 248 towards the internal region 214 and about the non-perforated score lines 252 and 256, respectively. The flaps 246 and 250 are folded towards the internal region 214 and about the non-perforated score lines 254 and 258, respectively. Each of the flaps 246 and 250 engage the flaps 244 and 248 so that the adhesive connects each of the flaps 246 and 250 to the flaps 244 and 248. The absence of the external coating 292 from the keep-out portions 294*a*, 294*b*, 296*a*, and 296*b* facilitates the adhesive connections of each of the flaps 246 and 250 to the flaps 244 and 248.

In several exemplary embodiments, the bag 216 is disposed in the internal region 214 before either the lower end 230 is formed or the upper end 228 is formed. In an exemplary embodiment, the lower end 230 is formed in accordance with the foregoing, then the bag 216 is disposed in the internal region 214 in accordance with the foregoing, and then the upper end 228 is formed in accordance with the foregoing.

In several exemplary embodiments, the operational aspects of the water box apparatus 210 are identical to that of the water box apparatus 10, except that the water box apparatus 210 contains an increased volume of treated water while still dramatically reducing the environmental footprint of drinking water packaging, mitigating the environmental impact of drinking water packaging. More particularly, in several exemplary embodiments, the water box apparatus 210 contains a volume of the treated water 218, and the amount of plastic in the bag 216 that contains the volume is 85% less than the amount of plastic needed for some 500 ml plastic water bottles and caps to contain that same volume of the treated water 218. In an exemplary embodiment, the water box apparatus 210 contains about 10 liters of the treated water 218, and the amount of plastic in the bag 216 that contains the 10 liters is 85% less than the amount of plastic needed for some 500 ml plastic water bottles and caps to contain the 10 liters of the treated water 218. In several exemplary embodiments, the water box apparatus 210 mitigates the environmental impacts of drinking water packaging. The water box apparatus 210 uses 85% less plastic than some bottled water solutions. The other operational aspects of the water box apparatus 210 are identical to that of the water box apparatus 10 and thus will not be described in further detail.

Figure 10:
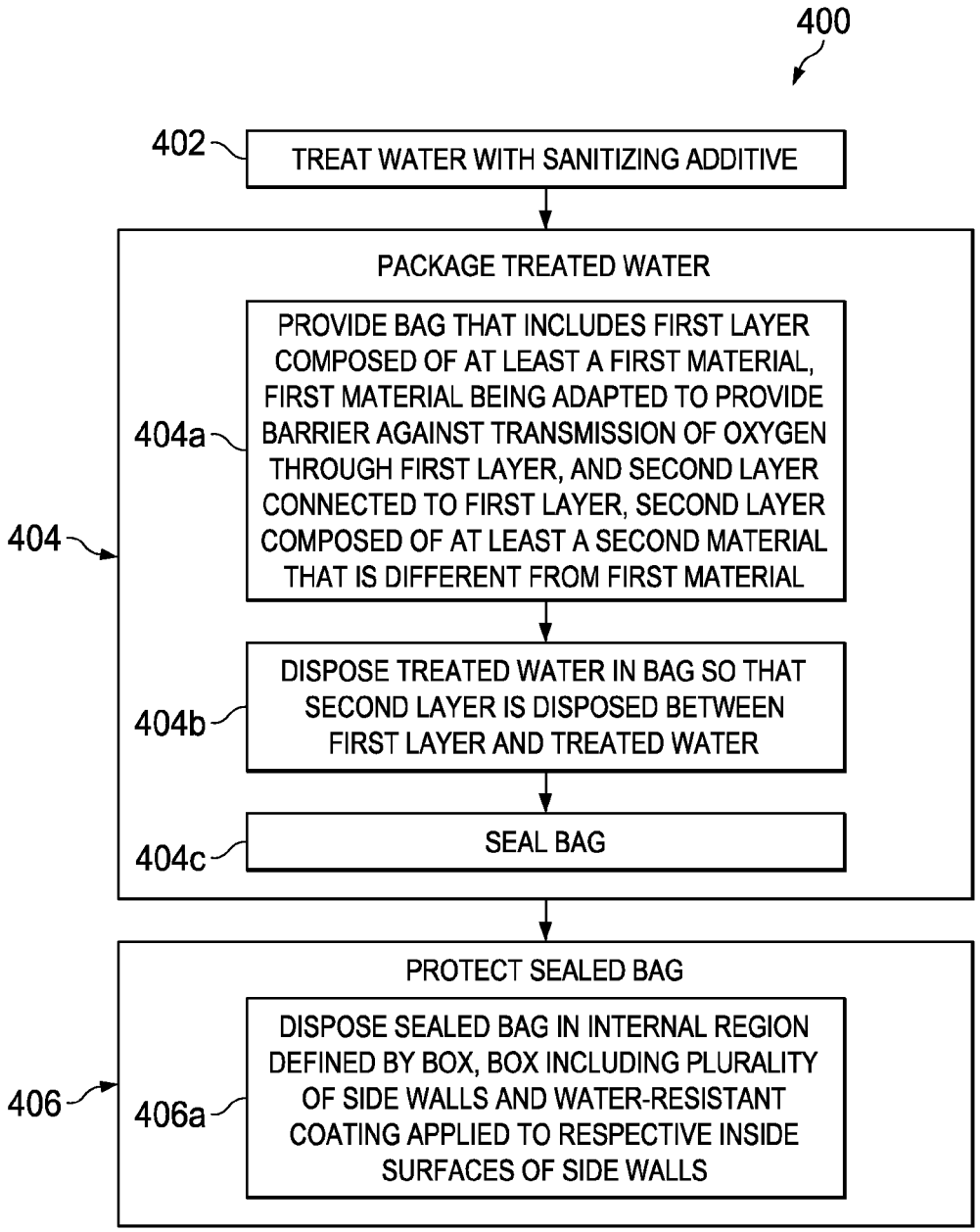
FIG. 10 is a flow chart illustration of a method, according to an exemplary embodiment.

In an exemplary embodiment, as illustrated in FIG. 10 with continuing reference to FIGS. 1-9, a method is generally referred to by the reference numeral 400 and includes treating water with a sanitizing additive at step 402 and packaging the treated water at step 404. The step 404 includes step 404*a*, at which a bag is provided, the bag including: a first layer composed of at least a first material, the first material being adapted to provide a barrier against the transmission of oxygen through the first layer; and a second layer connected to the first layer, the second layer composed of at least a second material that is different from the first material. At step 404*b*, the treated water is disposed in the bag. At step 404*c*, the bag is sealed. During or after the step 404, the sealed bag is protected at step 406. The step 406 includes step 406*a*, at which the sealed bag is disposed in an internal region defined by a box, the box including a plurality of side walls, each of the side walls defining an inside surface and an outside surface, wherein the internal region is at least partially defined by the respective inside surfaces of the side walls; and a water-resistant coating applied to the respective inside surfaces of the side walls; in several exemplary embodiments, when condensate forms on the bag within the internal region, the water-resistant coating applied to the respective inside surfaces of the side walls at least resists absorption of the condensate into the side walls of the box, thereby reducing the risk of the condensate causing structural damage to the box.

In an exemplary embodiment, the water 18 is not treated with a sanitizing additive; for example, the water 18 may instead be aseptically packaged, and/or packaged sanitarily using other procedure(s), at the water source. In an exemplary embodiment, the water 218 is not treated with a sanitizing additive; for example, the water 218 may instead be aseptically packaged, and/or packaged sanitarily using other procedure(s), at the water source. In an exemplary embodiment, the step 402 is omitted from the method 400 and the water packaged at the step 404 is not treated water;

for example, the water may instead be aseptically packaged, and/or packaged sanitarily using other procedure(s), at the water source at the step 404.

In an exemplary embodiment, instead of, or in addition to ozone, the water 18 is treated with one or more other sanitizing additives. In an exemplary embodiment, instead of, or in addition to ozone, the water 218 is treated with one or more other sanitizing additives.

In several exemplary embodiments, instead of 5 liters, the water box apparatus 10 can be modified to accommodate a wide range of different volumes of the water 18, such as, for example, 2, 3, 6, 7, 8, or 9 liters. In several exemplary embodiments, instead of 10 liters, the water box apparatus 210 can be modified to accommodate a wide range of different volumes of the water 218, such as, for example, 11, 12, 13, 14, or 15 liters.

In an exemplary embodiment, instead of the four side walls 20, 22, 24, and 26, the box 12 may include two arcuate-shaped side walls to form an oval-shaped cross section of the box 12 (rather than a square or rectangular cross section). In an exemplary embodiment, instead of the four side walls 20, 22, 24, and 26, the box 12 may include three side walls so that the box 12 has a cross section generally in the form of a triangle. In an exemplary embodiment, instead of the four side walls 20, 22, 24, and 26, the box 12 may include more than four side walls so that the box 12 has a cross section generally in the form of a pentagon, hexagon, etc. In an exemplary embodiment, the box 12 includes one side wall, which forms a tube so that the box 12 has a cross section generally in the form of a circle.

In an exemplary embodiment, instead of, or in addition to the opening 42 providing a handle feature, one or more handles are connected to the box 12 at the upper end 28, to one or more of the side walls 20, 22, 24, and 26, to another portion of the box 12, or any combination thereof; these one or more handles that are connected to the box 12 may be used to carry the water box apparatus 10; in several exemplary embodiments, the one or more handles may be one or more plastic handles.

In an exemplary embodiment, instead of, or in addition to the openings 242 and 243*b* providing handle features, one or more handles are connected to the box 212 at the upper end 228, to one or more of the side walls 220, 222, 224, and 226, to another portion of the box 212, or any combination thereof; these one or more handles that are connected to the box 212 may be used to carry the water box apparatus 210; in several exemplary embodiments, the one or more handles may be one or more plastic handles.

In several exemplary embodiments, the flaps 46 and 50 may partially or completely overlap, and/or the flaps 62 and 66 may partially or completely overlap. In several exemplary embodiments, the flaps 246 and 250 may partially or completely overlap, and/or the flaps 262 and 266 may partially or completely overlap. In several exemplary embodiments, the respective sets of the flaps of the box 12 and 212 may be arranged, relative to one another, in a wide variety of configurations other than the configurations included in the exemplary embodiments described above and illustrated in FIGS. 1-3 and 6-9.

In several exemplary embodiments, instead of at the corner 16*a* of the bag 16, the spout 19 may be connected to the bag 16 at other locations thereof such as, for example, in the middle of the bag 16, and/or a location in which the spout 19 is positioned so that the spout 19 extends through another one of the side walls 22, 24, and 26 rather than through the side wall 20 (the location of the opening 36 would be correspondingly moved to the other one of the side walls 22, 24, and 26). In several exemplary embodiments, instead of at the lower middle portion 216*a* of the bag 216, the spout 219 may be connected to the bag 216 at other locations thereof such as, for example, in a corner portion of the bag 216, and/or a location in which the spout 219 is positioned so that the spout 219 extends through another one of the side walls 220, 222, and 224 rather than through the side wall 226 (the location of the opening 236 would be correspondingly moved to the other one of the side walls 220, 222, and 224).

In an exemplary embodiment, a plastic band is connected to the respective inside surfaces of the box 12, extending in a direction that is perpendicular to the height 32 of the box 12; in an exemplary embodiment, the plastic band is, or includes, sesame tape. The opposing ends of the plastic band are connected when the box 12 is in the assembled configuration. In an exemplary embodiment, the plastic band is connected to the respective outside surfaces of the box 12, extends in a direction that is perpendicular to the height 32 of the box 12, and the opposing ends of the plastic band are connected when the box 12 is in the assembled configuration. In several exemplary embodiments, the plastic band reinforces the structural integrity of the box 12 during the operation of the water box apparatus 10. In several exemplary embodiments, the plastic band resists bulging of the box 12 during the operation of the box apparatus 10.

In an exemplary embodiment, a plastic band is connected to the respective inside surfaces of the box 212, extending in a direction that is perpendicular to the height of the box 212; in an exemplary embodiment, the plastic band is, or includes, sesame tape. The opposing ends of the plastic band are connected when the box 212 is in the assembled configuration. In an exemplary embodiment, the plastic band is connected to the respective outside surfaces of the box 212, extends in a direction that is perpendicular to the height of the box 212, and the opposing ends of the plastic band are connected when the box 212 is in the assembled configuration. In several exemplary embodiments, the plastic band reinforces the structural integrity of the box 212 during the operation of the water box apparatus 210. In several exemplary embodiments, the plastic band resists bulging of the box 212 during the operation of the box apparatus 210.

In an exemplary embodiment, the water box apparatus 10 does not include the water-resistant coating 82. In an exemplary embodiment, the water box apparatus 210 does not include a water-resistant coating, much less a water-resistant coating applied to the respective inside surfaces of the side walls 220, 222, 224, and 226. In an exemplary embodiment, the water box apparatus 10 does not include the external coating 92. In an exemplary embodiment, the water box apparatus 210 does not include the external coating 292.

The present disclosure introduces an apparatus, including a box including one or more side walls, each of the one or more side walls defining an inside surface and an outside surface; an internal region at least partially defined by the respective inside surfaces of the one or more side walls; a bag disposed in the internal region; and drinking water contained in the bag, the drinking water being non-alcoholic; wherein the bag is adapted to protect the drinking water contained therein from contaminants, tastes, and odors, each of which originates from either the bag itself or a source external to the bag. In an exemplary embodiment, the apparatus includes a water-resistant coating applied to the respective inside surfaces of the one or more side walls; wherein, when condensate forms on the bag within the internal region, the water-resistant coating applied to the respective inside surfaces of the one or more side walls at least resists absorption of the condensate into the one or more side walls of the box. In an exemplary embodiment, the water-resistant coating applied to the respective inside surfaces of the one or more side walls at least resists absorption of the condensate into the one or more side walls to reduce the risk of the condensate causing structural damage to the box. In an exemplary embodiment, the drinking water is treated with a sanitizing additive. In an exemplary embodiment, the sanitizing additive is ozone and the treated drinking water is ozonated drinking water. In an exemplary embodiment, the bag includes a spout adapted to permit the drinking water to be dispensed from the bag; wherein the box includes one or more perforated score lines formed in a first side wall of the plurality of side walls; wherein the bag is disposed in the internal region so that the spout is positioned in the vicinity of the one or more perforated score lines; wherein an opening is formed in the first side wall when the one or more perforated score lines are broken; and wherein the opening and the spout are sized so that the spout is permitted to extend through the opening when the one or more perforated score lines are broken. In an exemplary embodiment, the box further includes first and second ends spaced in a parallel relation and between which the one or more side walls extend; wherein the spacing between the first and second ends defines the height of the box; and wherein each of the one or more side walls includes: a first linerboard, the first linerboard defining the inside surface; a second linerboard connected to the first linerboard; and a medium positioned between the first linerboard and the second linerboard. In an exemplary embodiment, the medium includes a plurality of flutes extending along the height of the box; and wherein the extension of the flutes along the height of the box facilitates the ability of the box to structurally withstand loads applied against the one or more side walls as a result of the bag containing the drinking water and being disposed in the internal region. In an exemplary embodiment, each of the one or more side walls further includes: a label connected to the second linerboard, the label defining the outside surface of the side wall; and an external coating applied to at least a portion of the label and adapted to at least resist absorption of moisture into the side wall.

The present disclosure also introduces a method including packaging drinking water, the drinking water being non-alcoholic, wherein packaging the drinking water includes: providing a bag; disposing the drinking water in the bag; and sealing the bag, wherein the sealed bag protects the drinking water from contaminants, tastes, and odors, each of which originates from either the bag itself or a source external to the bag; and protecting the sealed bag, including: disposing the sealed bag in an internal region defined by a box, the box including: one or more side walls, each of the one or more side walls defining an inside surface and an outside surface, wherein the internal region is at least partially defined by the respective inside surfaces of the one or more side walls. In an exemplary embodiment, the box further includes: a water-resistant coating applied to the respective inside surfaces of the one or more side walls; wherein, when condensate forms on the bag within the internal region, the water-resistant coating applied to the respective inside surfaces of the one or more side walls at least resists absorption of the condensate into the one or more side walls of the box. In an exemplary embodiment, the water-resistant coating applied to the respective inside surfaces of the one or more side walls at least resists absorption of the condensate into the one or more side walls of the box to reduce the risk of the condensate causing structural damage to the box. In an exemplary embodiment, the method includes treating the drinking water with a sanitizing additive. In an exemplary embodiment, the sanitizing additive is ozone; and wherein treating the drinking water with the sanitizing additive includes ozonating the drinking water. In an exemplary embodiment, the bag includes a spout adapted to permit the drinking water to be dispensed from the bag; wherein the box includes one or more perforated score lines formed in a first side wall of the one or more side walls; wherein the bag is disposed in the internal region so that the spout is positioned in the vicinity of the one or more perforated score lines; wherein an opening is formed in the first side wall when the one or more perforated score lines are broken; and wherein the opening and the spout are sized so that the spout is permitted to extend through the opening when the one or more perforated score lines are broken. In an exemplary embodiment, the box includes first and second ends spaced in a parallel relation and between which the one or more side walls extend; wherein the spacing between the first and second ends defines the height of the box; and wherein each of the one or more side walls includes: a first linerboard, the first linerboard defining the inside surface; a second linerboard connected to the first linerboard; and a medium positioned between the first linerboard and the second linerboard. In an exemplary embodiment, the medium includes a plurality of flutes extending along the height of the box; and wherein the extension of the flutes along the height of the box facilitates the ability of the box to structurally withstand loads applied against the one or more side walls as a result of the bag containing the drinking water and being disposed in the internal region. In an exemplary embodiment, each of the one or more side walls further includes: a label connected to the second linerboard, the label defining the outside surface of the side wall; and an external coating applied to at least a portion of the label and adapted to at least resist absorption of moisture into the side wall.

The present disclosure also introduces a kit for packaging drinking water, the drinking water being non-alcoholic, the kit including: a bag in which the drinking water is adapted to be contained; and a box having unassembled and assembled configurations; wherein, when the drinking water is contained in the bag and the bag is sealed, the bag is adapted to protect the drinking water from contaminants, tastes, and odors, each of which originates from either the bag itself or a source external to the bag; and wherein the bag is adapted to be disposed in the box when the drinking water is contained in the bag, the bag is sealed, and the box is in the assembled configuration. In an exemplary embodiment, the box defines a first surface and includes a water-resistant coating applied to the first surface; wherein the water-resistant coating is adapted to at least resist absorption into the box of condensate formed on the bag when the drinking water is contained in the bag, the box is in the assembled configuration, and the bag is disposed in the box. In an exemplary embodiment, the water-resistant coating is adapted to at least resist absorption of the condensate into the box to reduce the risk of the condensate causing structural damage to the box. In an exemplary embodiment, the drinking water is treated with a sanitizing additive. In an exemplary embodiment, the sanitizing additive is ozone and the treated drinking water is ozonated drinking water. In an exemplary embodiment, the box includes a piece of corrugated fiberboard, the piece of corrugated fiberboard including: a first linerboard, the first linerboard defining the first surface; a second linerboard connected to the first linerboard; and a medium positioned between the first linerboard and the second linerboard. In an exemplary embodiment, the piece of corrugated fiberboard further includes parallel-spaced first and second score lines formed in the first surface of the first linerboard; wherein the spacing between the first and second score lines is generally equal to the height of the box when the box is in the assembled configuration; wherein each of the flutes extends along the height of the box when the box is in the assembled configuration; and wherein the extension of the flutes along the height of the box facilitates the ability of the box to structurally withstand loads applied against the corrugated fiberboard as a result of the bag containing the drinking water and being disposed in the internal region. In an exemplary embodiment, the corrugated fiberboard further includes: a label connected to the second linerboard; and an external coating applied to at least a portion of the label and adapted to at least resist absorption of moisture into the second linerboard when the box is in the assembled configuration. In an exemplary embodiment, when the box is in the unassembled configuration, the piece of corrugated fiberboard is planar and the first and second linerboards are spaced in a generally parallel relation. In an exemplary embodiment, the bag includes a spout adapted to permit the drinking water to be dispensed from the bag; wherein the box further includes a piece of corrugated fiberboard having one or more perforated score lines formed therein; wherein an opening is formed in the piece of corrugated fiberboard when the one or more perforated score lines are broken; and wherein the opening and the spout are sized so that the spout is permitted to extend through the opening when the one or more perforated score lines are broken.

It is understood that variations may be made in the foregoing without departing from the scope of the present disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," "up," "down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously, and/or sequentially. In several exemplary embodiments, the steps, processes, and/or procedures may be merged into one or more steps, processes, and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures.

What is claimed is:

1. A water box apparatus configured to transport, store, and dispense drinking water for human consumption, the water box apparatus comprising:

a box having a length, width, and height, the box comprising:

lower and upper ends spaced in a parallel relation, wherein the parallel spacing between the lower and upper ends defines the height of the box;

first and second side walls extending vertically from the lower end to the upper end, wherein the first and second side walls are spaced in a parallel relation, and wherein the parallel spacing between the first and second side walls defines the width of the box;

third and fourth side walls extending vertically from the lower end to the upper end, wherein the third and fourth side walls are spaced in a parallel relation, wherein the parallel spacing between the third and fourth side walls defines the length of the box, the length of the box being greater than the width of the box, wherein each of the third and fourth side walls extends horizontally from the first side wall to the second side wall, wherein each of the first, second, third, and fourth side walls defines an inside surface, and wherein each of the first, second, third, and fourth side walls comprises:

a first linerboard, the first linerboard defining the inside surface, a second linerboard connected to the first linerboard, and a medium positioned between the first linerboard and the second linerboard, the medium comprising a plurality of flutes extending vertically along the height of the box;

wherein the plurality of flutes defines an undulating cross-section at a vertical position along the height of the box, the undulating cross-section being spaced in a parallel relation from each of the lower and upper ends;

one or more perforated score lines formed in the third side wall and thus within the width of the box, wherein the one or more perforated score lines are vertically positioned closer to the lower end than to the upper end, wherein a spout opening is formed in the third side wall when the one or more perforated score lines are broken, wherein the spout opening is vertically spaced from the lower end so that a portion of the third side wall extends between the lower end and the spout opening, wherein a first flap is formed when the one or more perforated score lines are broken, wherein the first flap is hingedly connected to the third side wall via a first non-perforated score line formed in the third side wall and spaced in a parallel relation from the lower end, wherein the spout opening is vertically positioned between the lower end and the first non-perforated score line, and wherein the first flap is permitted to pivot upward, about the first non-perforated score line and away from the third side wall;

one or more other perforated score lines formed in the fourth side wall and thus within the width of the box, wherein the one or more other perforated score lines are vertically positioned closer to the upper end than to the lower end, wherein a handle opening is formed in the fourth side wall when the one or more other perforated score lines are broken, wherein a second flap is formed when the one or more other perforated score lines are broken, wherein the second flap is hingedly connected to the fourth side wall via a second non-perforated score line formed in the fourth side wall and spaced in a parallel relation from the upper end, wherein the second flap is permitted to pivot about the second non-perforated score line, and wherein the box can be carried or held by a portion of the fourth side wall located at the hinged connection between the second flap and the fourth side wall;

an internal region at least partially defined by the respective inside surfaces of the first, second, third, and fourth side walls;

a bag disposed in the internal region, the bag having an outer perimeter, the bag comprising:

a seam weld formed around the outer perimeter, first and second upper corner portions, and first and second lower corner portions;

drinking water contained in the bag, the drinking water being non-alcoholic;

wherein the bag is adapted to protect the drinking water contained therein from contaminants, tastes, and odors, each of which originates from either the bag itself or a source external to the bag, wherein the bag is adapted to protect the drinking water contained therein from a first contaminant, taste, or odor that originates from the bag itself, the first contaminant, taste, or odor being one of said contaminants, tastes, and odors, wherein the bag is adapted to protect the drinking water contained therein from a second contaminant, taste, or odor that originates from the source external to the bag, the second contaminant, taste, or odor being another of said contaminants, tastes, and odors, and wherein the extension of the flutes, vertically along the height of the box, facilitates the ability of the box to structurally withstand loads applied against the first, second, third, and fourth side walls as a result of the bag containing the drinking water and being disposed in the internal region;

and a spout connected to the bag and adapted to permit the drinking water to be dispensed from the bag for human consumption, wherein the spout is positioned so that the spout is closer to the first lower corner portion than to each of the second lower corner portion and the first and second upper corner portions, wherein the spout opening is sized so that the spout is permitted to extend through the opening, and wherein the first lower corner portion of the bag is bent or twisted in a direction towards the inside surface of the third side wall so that the spout is permitted to be pulled so that the spout extends through the spout opening.

2. The water box apparatus of claim 1, further comprising a water-resistant coating applied to the respective inside surfaces of the first, second, third, and fourth side walls.

3. The water box apparatus of claim 2, wherein, when condensate forms on the bag within the internal region, the water-resistant coating applied to the respective inside surfaces of the first, second, third, and fourth side walls at least resists absorption of the condensate into the first, second, third, and fourth side walls to reduce the risk of the condensate causing structural damage to the box, permitting the water box apparatus to be repeatedly refrigerated or chilled with little or no structural damage to the box due to the condensate formed on the bag within the internal region.

4. The water box apparatus of claim 1, wherein the drinking water is treated with a sanitizing additive.

* * * * *